US009714777B1

(12) United States Patent
Wu

(10) Patent No.: US 9,714,777 B1
(45) Date of Patent: Jul. 25, 2017

(54) HEAT PIPE AND RADIATOR SYSTEM WITH THERMOELECTRIC COOLER

(71) Applicant: Space Systems/Loral, LLC, Palo Alto, CA (US)

(72) Inventor: Gordon Wu, Sunnyvale, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 574 days.

(21) Appl. No.: 14/183,263

(22) Filed: Feb. 18, 2014

(51) Int. Cl.
*F25B 21/02* (2006.01)

(52) U.S. Cl.
CPC ..... *F25B 21/02* (2013.01)

(58) Field of Classification Search
CPC ..... F25B 21/02; B64G 1/50; B64G 1/503; B64G 1/506
See application file for complete search history.

(56) References Cited

U.S. PATENT DOCUMENTS 4,802,929 A 2/1989 Schock
4,880,050 A * 11/1989 Nakamura ..... B64G 1/50 165/104.14
6,776,220 B1 8/2004 Low et al.
7,048,233 B2 5/2006 Combes
2002/0062648 A1* 5/2002 Ghoshal ..... F28D 15/0233 62/3.7
2004/0040691 A1* 3/2004 Jacque ..... F28D 15/043 165/42
2010/0223942 A1 9/2010 Merino et al.
2010/0243817 A1 9/2010 McKinnon et al.

OTHER PUBLICATIONS

Supper, W., "Thermal Challenges for Future Telecom Spacecraft and their relation to the ARTES-5 2006 Workplan", ESTEC, Apr. 12, 2006, 17 pages.
Gilmore, David G., "Spacecraft Thermal Control Handbook, Volume I: Fundamental Technologies", Second Edition, The Aerospace Press, El Segundo, California, American Institute of Aeronautics and Astronautics, Inc., Reston, Virginia, 2002, Chapter 13, "Thermoelectric Coolers", 17 pages.

* cited by examiner

*Primary Examiner* — Elizabeth Martin
(74) *Attorney, Agent, or Firm* — Weaver Austin Villeneuve & Sampson LLP

(57) ABSTRACT

A thermal control arrangement includes a first heat pipe and a plurality of thermoelectric coolers. The plurality of thermoelectric coolers is disposed between the first heat pipe and a thermal load, each of the plurality of thermoelectric coolers having a first surface and a second surface, each respective first surface having a first thermally conductive coupling to the first heat pipe and each respective second surface having a second thermally conductive coupling to the thermal load.

9 Claims, 4 Drawing Sheets

HEAT PIPE AND RADIATOR SYSTEM WITH THERMOELECTRIC COOLER

TECHNICAL FIELD

This invention relates generally to thermal control techniques, and, more particularly, to an improved spacecraft thermal control arrangement including a heat pipe coupled with thermoelectric coolers.

BACKGROUND OF THE INVENTION

The assignee of the present invention manufactures and deploys spacecraft for, inter alia, communications and broadcast services from geostationary orbit. The present invention relates to a spacecraft radiator system including heat pipes and thermoelectric coolers. The thermoelectric coolers may also be referred to as Peltier devices.

Ordinarily, heat pipes are used to transfer and distribute thermal energy from heat sources such as operating electronic units to and across radiator panel surfaces from where it may be radiated into space. When the spacecraft is operating on-orbit, the radiator panels, generally, will be disposed in a North or South facing direction, because the North or South panels experience a solar radiation exposure that is relatively benign and stable compared to the East/West panels which experience significant diurnal cycles as the spacecraft orbits the Earth. As a result, conventional spacecraft designs frequently provide that North and South equipment panels are densely occupied by heat dissipating equipment such as traveling wave tube amplifiers and solid-state power amplifiers. U.S. Pat. No. 6,776,220, assigned to the assignee of the present invention, and hereby incorporated by reference into the present application, discloses known spacecraft radiator systems, including heat pipes.

Market demands for spacecraft offering higher power and more complex payloads challenge spacecraft designers to find mounting locations on which to dispose electronic components, including payload equipment. Although, as discussed above, conventional design practice is to preferentially mount payload equipment on North-South radiator panels, other locations must be found for at least some such equipment. For example, heat dissipating equipment may be disposed on transverse panels that are thermally coupled to the South radiator panels by way of the L-shaped heat pipes.

Some payload equipment, such as, for example, filters and low noise amplifiers (LNA's) dissipate relatively small amounts of heat, and may be disposed on spacecraft equipment panels that are not thermally coupled to North-South radiators. In such locations, however, the baseplate temperatures experience substantially diurnal variation and/or may be higher than desirable.

As a result, an improved approach to thermal control of spacecraft payload equipment is desirable.

SUMMARY

The present disclosure contemplates an improved arrangement for thermal control of spacecraft components.

In some implementations, the arrangement includes a first heat pipe and a plurality of thermoelectric coolers. The plurality of thermoelectric coolers is disposed between the first heat pipe and a thermal load, each of the plurality of thermoelectric coolers having a first surface and a second surface, each respective first surface having a first thermally conductive coupling to the first heat pipe and each respective second surface having a second thermally conductive coupling to the thermal load.

In some implementations, the thermal load may include at least one heat dissipating component of a spacecraft. The arrangement may further include an equipment panel of the spacecraft, the equipment panel being thermally coupled with the first heat pipe. The equipment panel may include a radiator panel. The first heat pipe may be embedded in the radiator panel.

In some implementations, the at least one heat dissipating component is a low noise amplifier (LNA) or a filter.

In some implementations, the thermal load may include a second heat pipe disposed between the plurality of thermoelectric coolers and at least one heat dissipating component, and the second thermally conductive coupling may include the second heat pipe. The second heat pipe may be configured to spread heat from the at least one heat dissipating component, the second heat pipe having an average temperature substantially lower than the first heat pipe. Each respective first surface of the plurality of thermoelectric coolers may have a substantially lower temperature than the respective second surface. A first temperature of each first respective surface may be approximately 40° C. lower than a second temperature of the second respective surface. The at least one heat dissipating component may include a low noise amplifier (LNA) or a filter.

In some implementations, a thermal control arrangement for a spacecraft includes a first heat pipe, a second heat pipe, a plurality of thermoelectric coolers, an equipment panel, and at least one heat dissipating component. The plurality of thermoelectric coolers is disposed between the first heat pipe and the second heat pipe, each of the plurality of thermoelectric coolers having a first surface and a second surface, each respective first surface having a thermally conductive coupling with the first heat pipe and each respective second surface having a thermally conductive coupling with the second heat pipe. The equipment panel is thermally coupled with the first heat pipe. The second heat pipe has a thermally conductive coupling with the at least one heat dissipating component.

BRIEF DESCRIPTION OF THE DRAWINGS

Features of the invention are more fully disclosed in the following detailed description of the preferred embodiments, reference being had to the accompanying drawings, in which.

Figure 1:
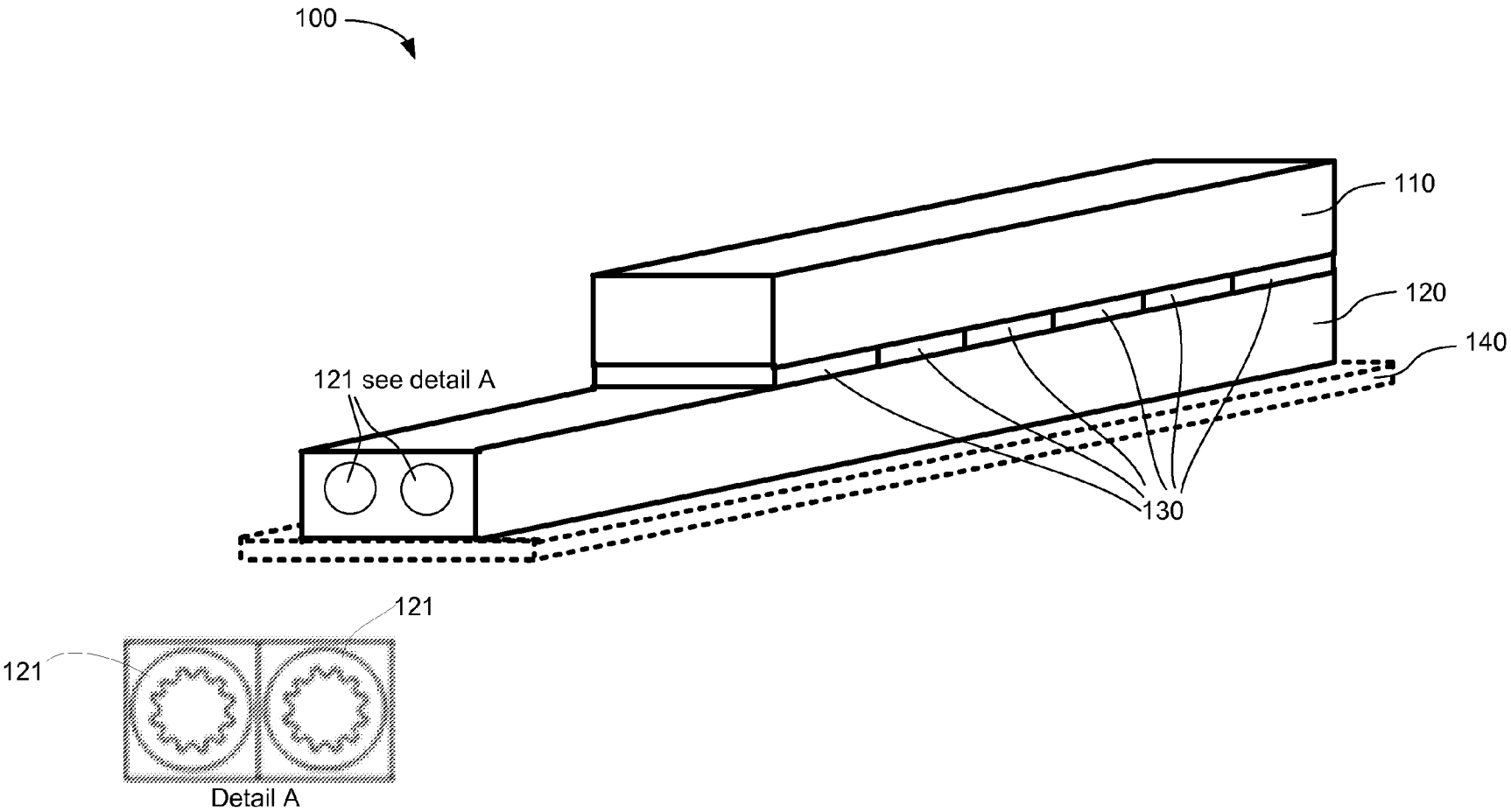
FIG. 1 illustrates a thermal control arrangement according to an implementation.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific examples of embodiments will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. It will be understood that although the terms "first" and "second" are used herein to describe various elements, these elements should not be limited by these terms. These terms are used only to distinguish one element from another element. As used herein, the term "and/or" includes any and all combinations of one or more of the associated listed items. The symbol "/" is also used as a shorthand notation for "and/or".

The presently disclosed techniques provide for thermal control of spacecraft components, particularly low heat dissipating payload equipment. The techniques achieve more tightly controlled and generally lower equipment baseplate temperatures for such equipment than would be possible in the absence of the present teachings. In some implementations, the techniques contemplate an arrangement including a first, proximate, heat pipe, a plurality of Peltier devices, and a second, distal, heat pipe. Advantageously, the plurality of Peltier devices may be sandwiched between the first heat pipe and the second heat pipe. As a result of the proposed arrangement the baseplate temperature of a first heat dissipating component thermally coupled with the first heat pipe may be maintained at a reduced and/or more precisely controlled temperature.

A better appreciation of features and advantages of the proposed techniques may be obtained by referring first to FIG. 1. In the illustrated implementation, a thermal control arrangement 100 includes a thermal load 110, a first heat pipe module 120 and, sandwiched therebetween, a plurality of thermoelectric coolers 130. The first heat pipe module 120 may be conductively coupled to an equipment panel 140 of a spacecraft (not illustrated). The equipment panel 140 may be a radiator panel. For example, the equipment panel 140 may be an external panel of the spacecraft that radiates heat to space, but this is not necessarily so. In some implementations, the equipment panel may be an internal panel of a spacecraft that does not have a direct view to space.

The first heat pipe module 120 may include one or more heat pipes. In the illustrated implementation, for example, first heat pipe module 120 includes two heat pipes 121. Referring to Detail A of FIG. 1, it may be observed that an axial cross section of heat pipe 121 may include axial grooves, disposed between an arrangement of fins or splines. Each heat pipe typically constitutes a closed, self-contained vessel filled with a predetermined amount of an appropriate fluid, such as ammonia, toluene, or a water/isopropyl alcohol mixture. The fluid in the heat pipe may be in a partially liquid and a partially gaseous state. The extent and location of liquid state fluid and gaseous state fluid will depend on the temperature of environments to which various parts of the heat pipe are exposed.

Each of the plurality of thermoelectric coolers 130 may have a first surface and a second surface. Each respective first surface may have a thermally conductive coupling with the first heat pipe module 120 and each respective second surface may have a thermally conductive coupling with the thermal load 110. The plurality of thermoelectric coolers may be configured to use the Peltier effect to create a temperature difference when a voltage difference is imposed across terminals of each thermoelectric device. Consequently, the thermoelectric cooler 130 may also be referred to herein as a Peltier device. Advantageously, the temperature difference may be established between the respective first surface proximate to the thermal load 110 and the respective second surface proximate to the second heat pipe module 120.

Figure 2:
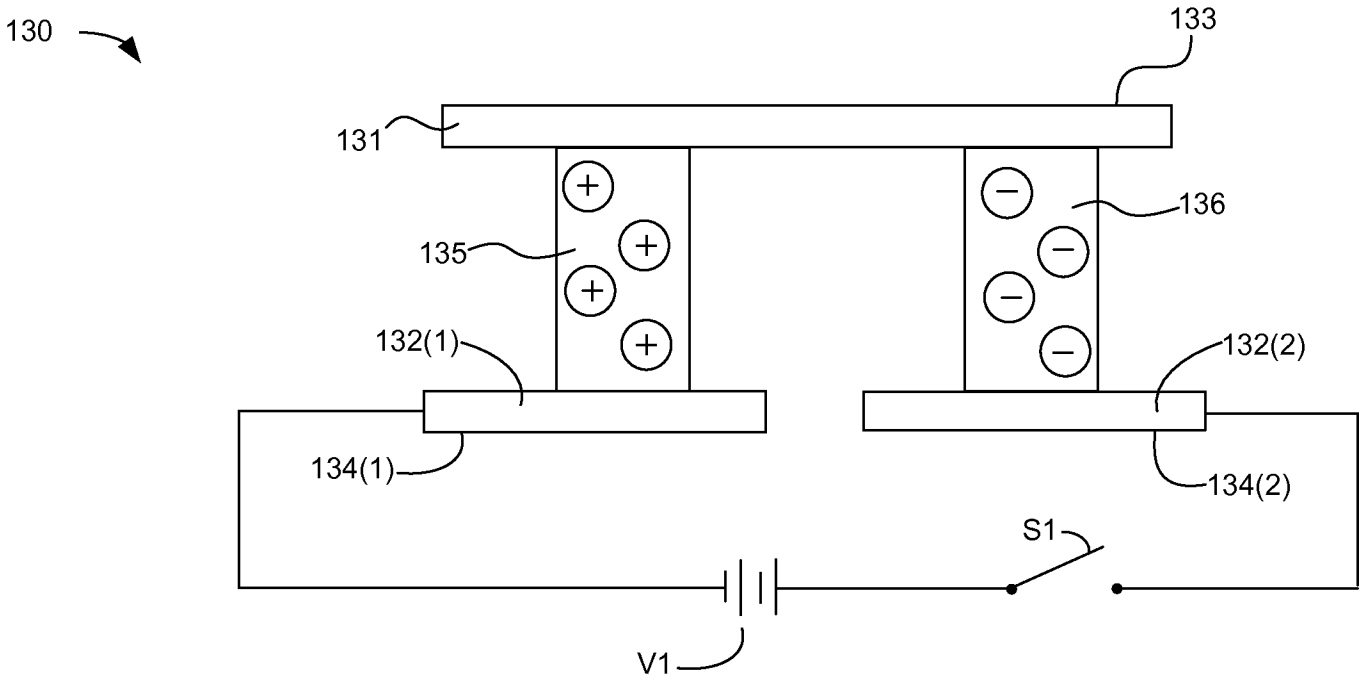
FIG. 2 illustrates a simplified schematic of a thermoelectric cooler.

The voltage difference may be imposed by a power supply (not illustrated) of the spacecraft. A simplified schematic of the thermoelectric cooler 130 is illustrated in FIG. 2. The thermoelectric cooler 130 includes cold junction 131 and hot junction 132. The hot junction 132 includes a first element 132(1) and a second element 132(2). The first element 132(1) and the second element 132(2) may be electrically coupled in series by way of P-type semiconductor material 135, cold junction 131, and N-type semiconductor material 136 with voltage source V1. It will be appreciated that when switch S1 is in a closed position, current will flow through thermoelectric cooler 130, and heat will be pumped from cold junction 131 to hot junction elements 132 (1) and 132(2). As a result, a substantial temperature gradient between the cold junction 131 and hot junction 132 may be achieved.

Advantageously, a first surface 133 of cold junction 131 may be configured to have a thermally conductive coupling with the thermal load 110, whereas a second surface 134 of hot junction 132 may be configured to have a thermally conductive coupling with the first heat pipe module 120. In some implementations, for example, a baseplate of the thermal load 110 may have a thermally conductive coupling with the first surface 133.

In some implementations, the thermal load 110 may be a heat dissipating component of a spacecraft. For example, the thermal load 110 may be a low noise amplifier or a filter.

Figure 3:
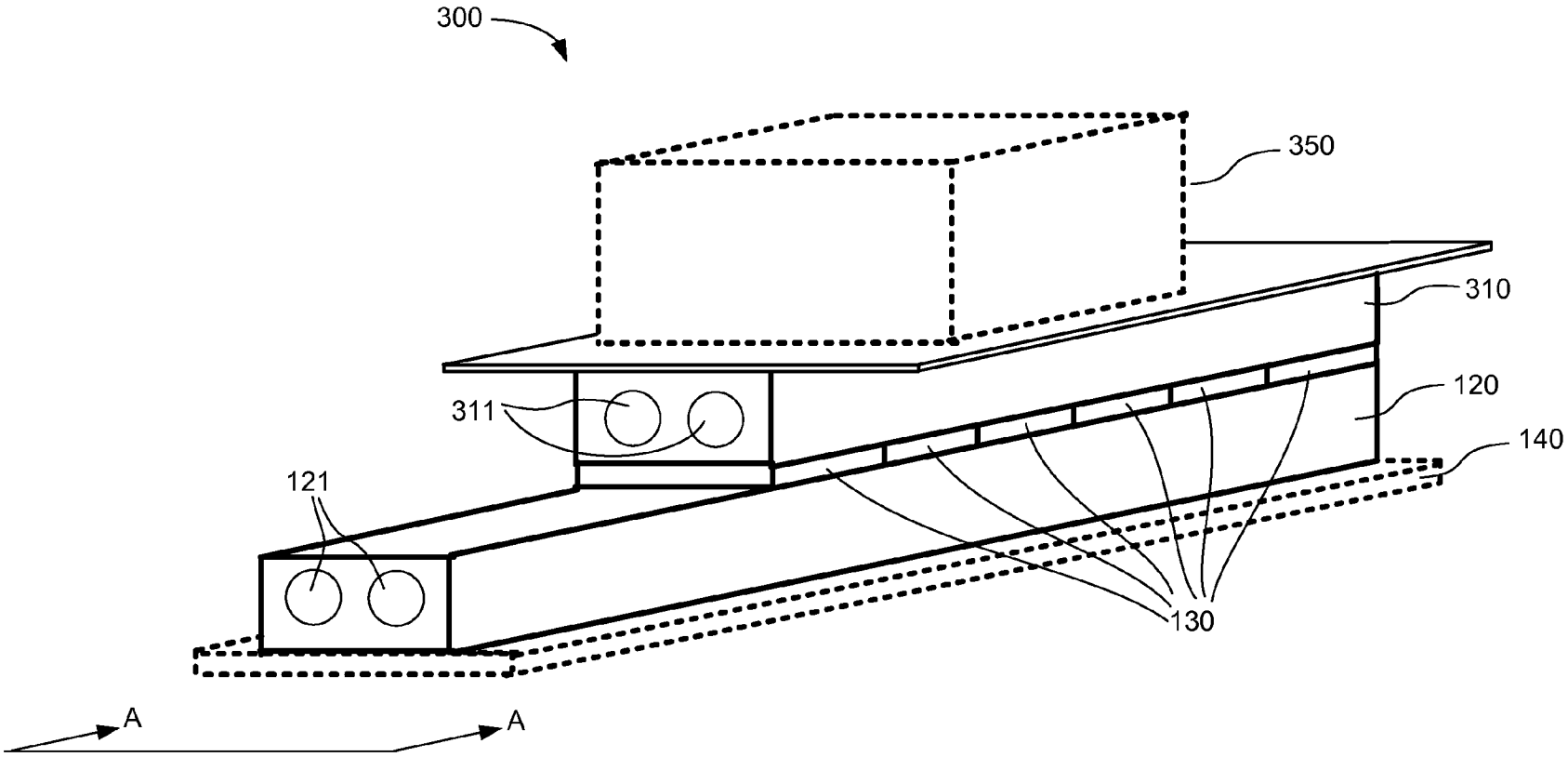
FIG. 3 illustrates a thermal control arrangement according to another implementation.

Referring now to FIG. 3, in some implementations a thermal control arrangement 300 includes a thermal load 310, a first heat pipe module 120 and, sandwiched therebetween, a plurality of thermoelectric coolers 130. The first heat pipe module 120 may be conductively coupled to an equipment panel 140 of a spacecraft (not illustrated). The equipment panel 140 may be a radiator panel, for example an external panel of the spacecraft that radiates heat to space, but this is not necessarily so. In some implementations, the equipment panel 140 may be an internal panel of a spacecraft that does not have a direct view to space. It will be appreciated that, whether or not the equipment panel 140 is an external panel an internal panel, heat pipe module 120 may be embedded in the panel. For example, where the equipment panel 140 is a honeycomb panel having relatively thin face skins, the heat pipe module 120 may be embedded between the face skins.

The first heat pipe module 120 may include one or more heat pipes. Likewise, as shown in the illustrated implementation, the thermal load 310 may include one or more heat pipes. For example, in the illustrated implementation thermal load 310 includes two heat pipes 311. Advantageously, the thermal load 310 may be conductively coupled with at least one heat dissipating component 350. Advantageously, the heat dissipating component 350 may be an electrical payload component that dissipates heat at a relatively low rate. For example, the heat dissipating component 350 may be a filter or an LNA. Advantageously, the heat pipes 311 may be configured to spread heat from the heat dissipating component 350 along the length of the thermal load 310.

In the illustrated implementation, a single heat dissipating unit 350 and six Peltier devices 130, are depicted. It will be appreciated, however, that a greater number of heat dissipating units 150 and any number of Peltier devices 130 may be contemplated. Advantageously, a sufficient number of Peltier devices 130 may be provided so as to provide, for example, 2-for-1 redundancy. In the illustrated implementation, for example, the six Peltier devices 130 may be arranged such that a first string of three devices forms a redundant circuit with a second string of three devices.

As a result of operation of the Peltier devices 130, an average temperature of heat pipes 311 may be substantially lower than an average temperature heat pipes 121.

Figure 4:
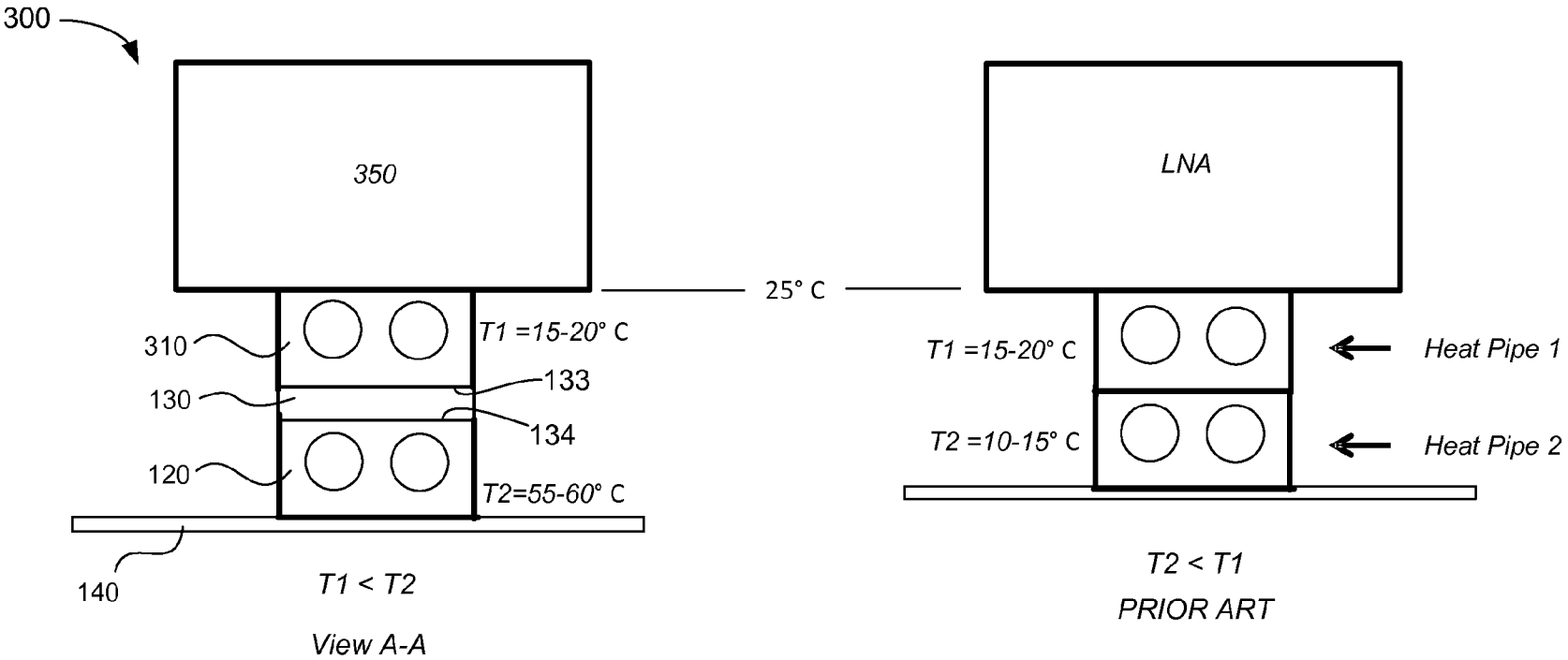
FIG. 4 illustrates a comparison between thermal control arrangement according to an implementation, and an arrangement of the prior art.

Referring now to FIG. 4, a comparison is illustrated between a view of arrangement 300 taken along the line A-A of FIG. 3, and an arrangement of the prior art. It will be appreciated that for an arrangement in accordance with the prior art, in order to remove heat from a heat dissipating component (in the illustrated example, an LNA) a baseplate temperature of the LNA must be hotter than temperature T1 of heat pipe 1, which in turn must be hotter than temperature T2 of heat pipe 2, which in turn must be hotter than the radiator. As a result, for a typical installation where an LNA baseplate temperature of 25° C. is desirable, the temperature of the equipment panel 140 must be lower than approximately 10°. Such a requirement is difficult or impossible to achieve in many practical situations. Indeed, for most actual spacecraft designs, equipment baseplate temperatures lower than on the order of 40 to 60° C. are not possible, at least in many equipment mounting locations.

In the implementation of arrangement 300, however, a substantial temperature gradient between the first surface 133 and the second surface 134 of the Peltier device 130 may be maintained at the cost of a reasonable amount of power provided to the Peltier device. As a result, for the same LNA baseplate temperature of 25° C. used in the preceding example, a temperature of the heat pipe 120 may be on the order of 55-60° C. Accordingly, equipment panel 140 may be operable at a temperature on the order of 50° C.

Peltier devices of the type contemplated by the present disclosure may have a coefficient of performance of approximately 0.4. The coefficient of performance is the ratio of heat removal measured in watts to input power of the Peltier device. In a particular implementation, for example, where 30 LNA's, each dissipating 1.5 W, are desired to be kept at a baseplate temperature of 25° C., the present inventor has determined that approximately 112 W of power (45 W/0.4) will be required by the Peltier devices.

The presently disclosed techniques may be used advantageously in a spacecraft system design to accomplish one or more of the following objectives. In some implementations substantially colder baseplate temperature may be achieved for a given amount of radiating surface area than is possible in the absence of the present invention. In other implementations, a baseplate temperature may be much more tightly controlled than is possible in the absence of the present invention. In still other implementations, radiator surface area may be reduced while maintaining component baseplate temperatures at levels conventionally achieved. Finally, in some implementations, the radiating surface area need not be exposed to space. In such implementations, the radiator surface may be exposed to an internal volume of the spacecraft, for example.

Thus, an improved thermal control arrangement for spacecraft components has been disclosed. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus comprising:

a first heat pipe;

at least one heat dissipating component of a spacecraft, the spacecraft including an equipment panel and a North-South radiator, the equipment panel being thermally coupled with the first heat pipe and not thermally coupled with the North-South radiator; and a plurality of thermoelectric coolers; wherein the plurality of thermoelectric coolers is disposed between the first heat pipe and the at least one heat dissipating component, each of the plurality of thermoelectric coolers having a first surface and a second surface, each respective first surface having a first thermally conductive coupling to the first heat pipe and each respective second surface having a second thermally conductive coupling to the the at least one heat dissipating component.

2. The apparatus of claim 1, wherein the equipment panel is a radiator panel.

3. The apparatus of claim 2, wherein the first heat pipe is embedded in the radiator panel.

4. The apparatus of claim 1, wherein the at least one heat dissipating component is a low noise amplifier (LNA) or a filter.

5. The apparatus of claim 1, wherein the thermal load is a second heat pipe disposed between the plurality of thermoelectric coolers and at least one heat dissipating component, and the second thermally conductive coupling includes the second heat pipe.

6. The apparatus of claim 5, wherein the second heat pipe is configured to spread heat from the at least one heat dissipating component, the second heat pipe having an average temperature substantially lower than the first heat pipe.

7. The apparatus of claim 6, wherein each respective first surface of the plurality of thermoelectric coolers has a substantially lower temperature than the respective second surface.

8. The apparatus of claim 6, wherein a first temperature of each first respective surface is approximately 40° C. lower than a second temperature of the second respective surface.

9. The apparatus of claim 5, wherein the at least one heat dissipating component is a low noise amplifier (LNA) or a filter.

* * * * *